US007495630B2

(12) United States Patent
Hu et al.

(10) Patent No.: US 7,495,630 B2
(45) Date of Patent: Feb. 24, 2009

(54) FEED POINT ADJUSTABLE PLANAR ANTENNA

(75) Inventors: Chuan-Ling Hu, Hsichih (TW); Yu-Wei Chen, Hsichih (TW); Chang-Lun Liao, Hsichih (TW); Chia-Sheng Liu, Hsichih (TW)

(73) Assignee: Chant Sincere Co., Ltd., Taipei County (TW)

( * ) Notice: Subject to any disclaimer, the term of this patent is extended or adjusted under 35 U.S.C. 154(b) by 2 days.

(21) Appl. No.: 11/757,366

(22) Filed: Jun. 2, 2007

(65) Prior Publication Data

US 2008/0297418 A1 Dec. 4, 2008

(51) Int. Cl.
*H01Q 1/38* (2006.01)

(52) U.S. Cl. ..... 343/846; 343/702; 343/830

(58) Field of Classification Search ..... 343/700 MS, 343/702, 824, 826, 828–830, 846, 857
See application file for complete search history.

(56) References Cited

U.S. PATENT DOCUMENTS

| | | | | |
|---|---|---|---|---|
| 7,289,071 | B2 * | 10/2007 | Hung et al. | 343/702 |
| 2005/0190108 | A1 * | 9/2005 | Lin et al. | 343/702 |
| 2008/0094303 | A1 * | 4/2008 | Tseng et al. | 343/848 |

* cited by examiner

*Primary Examiner*—Michael C Wimer

(57) ABSTRACT

The feed point adjustable planar antenna includes a ground component, a main radiation plane, a branch line extended from the main radiation plane, and a ground pin electrically connecting the radiation component with the ground component. If it needs to fine tune the frequency band interval after the design of the antenna is completed, the feed position of the coaxial cable to the branch line can be changed to achieve the fine tuning without cutting the antenna. The ground pin extends from a side edge of the ground component and the branch line is adjacent to the ground component. The branch line and the ground component form a larger coupling range than the conventional planar antenna does. In the mean time, the coaxial cable also has a larger feed range than the conventional planar antenna does.

10 Claims, 7 Drawing Sheets

FEED POINT ADJUSTABLE PLANAR ANTENNA

BACKGROUND OF THE INVENTION

1. Field of the Invention

The present invention relates generally to a planar antenna, and in particular to a feed point adjustable planar antenna.

2. The Prior Arts

A primary function of an antenna is to convert electromagnetic radiation energy in a transmission medium (usually air) and energy transmitted or received by a transceiver. During a process of energy transformation, discontinuous interfaces may occur between the transceiver and the antenna and between the antenna and the transmission medium. In a wireless communication system, the antenna needs to be designed according to characteristics of the two interfaces so that a continuous energy transmission path may be formed between the transceiver, the antenna and the transmission medium. Thus, a transmitting antenna can radiate energy of a transmitter to the transmission medium and a receiving antenna can transmit the energy of the electromagnetic radiation to the receiver.

There are many variations of antennas, such as dual-polarized antennas, helix antennas, planer inverted F antennas (PIFA), microstrip antennas, etc. The PIFA can achieve impedance matching without including extra inductance and capacity so it becomes increasingly popular.

The PIFA gets its name since its side view looks like an inverted letter "F". On one hand, because an operation length of the PIFA is only ¼ of an operation wavelength and the PIFA already includes a ground metal plane, the sensitivity to the ground metal plane in a module may be reduced. Thus, the PIFA is suitable for a Bluetooth module device. On the other hand, the PIFA only needs a metal conductor cooperating with an appropriate feed and antenna being short circuited to a position of the ground plane. Thus, its cost is low and the PIFA can be welded to a printed circuit board directly.

Generally, a size of an antenna component is changed to fine tune a frequency band interval according to different environment. However, in order not to affect the performance of the antenna, the sizes of different components cannot be drastically changed. Thus, the tuning is limited. In some cases, such as fluctuation of size parameters being too wide, even the size is changed, and it is still hard to meet an actual requirement. At the same time, in order to test the fine tuning, a part of the antenna is cut each time to test whether the requirement is met. If the requirement is not met, the antenna is cut again until the requirement is met. Therefore, although the method mentioned above is effective, it is time consuming and expensive. It is not an optimal method of fine tuning.

In order to solve the problem of fine tuning, a method for fine tuning is proposed in which the feed point of a coaxial cable is changed while the size of the antenna is not changed. However, in the structure of the antenna, a ground pin electrically connecting a radiation component and a ground component extends from a middle portion of a side of the ground component to the radiation component, which limits a coupling range between the radiation component and the ground component and further limits the feed position of the coaxial cable.

SUMMARY OF THE INVENTION

A primary objective of the present invention is to provide a feed point adjustable planar antenna, which fine tunes a frequency band interval of the planar antenna by changing the feed point of a coaxial cable to a branch line and thus makes the fine tuning convenient.

Another objective of the present invention is to provide a feed point adjustable planar antenna, whose ground pin extends from a side edge of the ground component and turns to form a branch line adjacent to the ground component. The branch line and the ground component form a larger coupling range and a coaxial cable has a larger feed range than a conventional planar antenna does.

The feed point adjustable planar antenna according to the present invention includes a ground component, a radiation component, and a ground pin electrically connecting the radiation component and the ground component. The radiation component comprises a main radiation plane and a branch line extended from the main radiation plane. The branch line is extended from the main radiation plane and is located close to the ground component. The branch line includes a first radiation line and a second radiation line. After a size of the antenna is designed, if a fine tuning of the frequency band interval is needed, the feed position of the coaxial cable to the branch line can be changed to achieve the tuning without cutting the antenna.

The present invention will be apparent to those skilled in the art by reading the following detailed description of a preferred embodiment thereof, with reference to the attached drawings, in which:

DETAILED DESCRIPTION OF THE PREFERRED EMBODIMENT

Figure 1A:
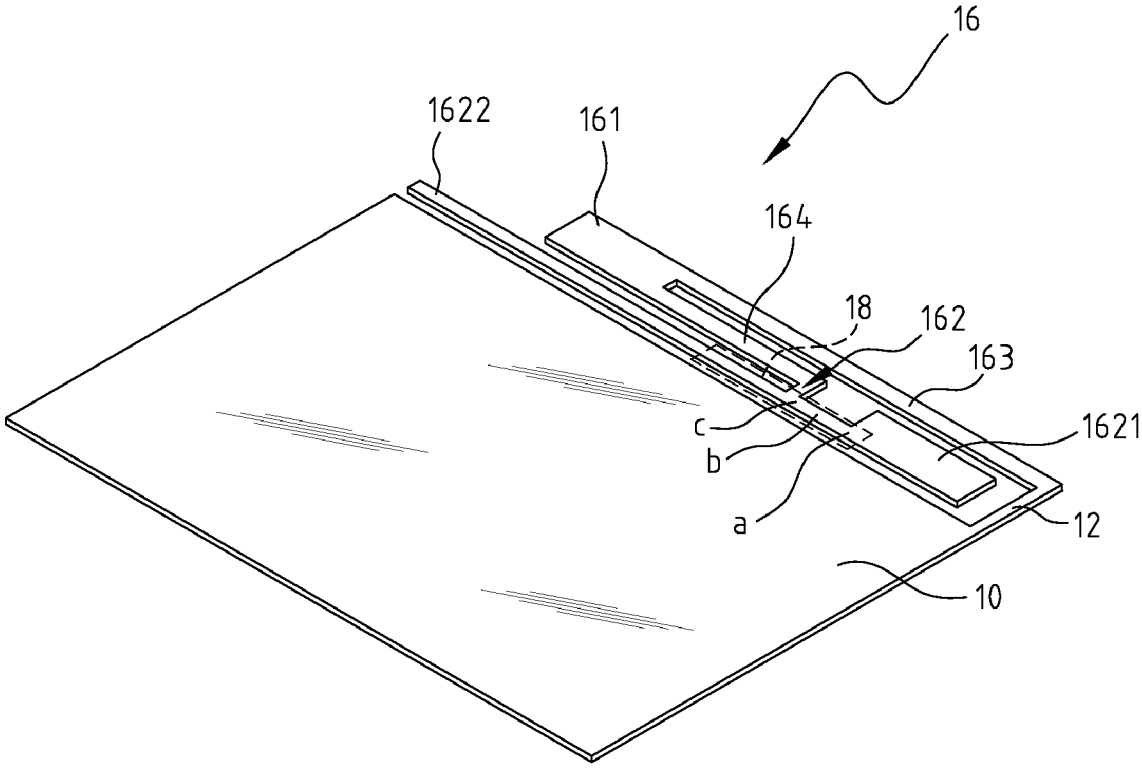
FIGS. 1A to 1C are schematic views showing a feed point adjustable planar antenna according to the present invention.
Figure 1B:
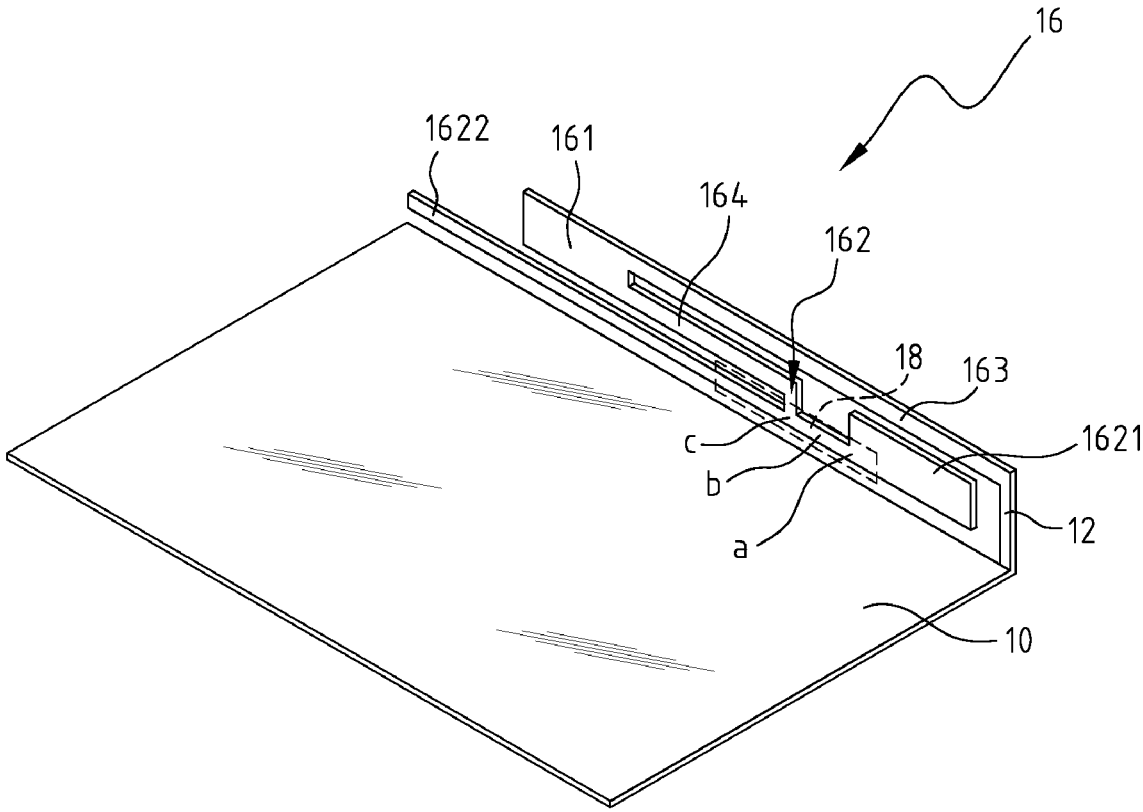
Figure 1C:
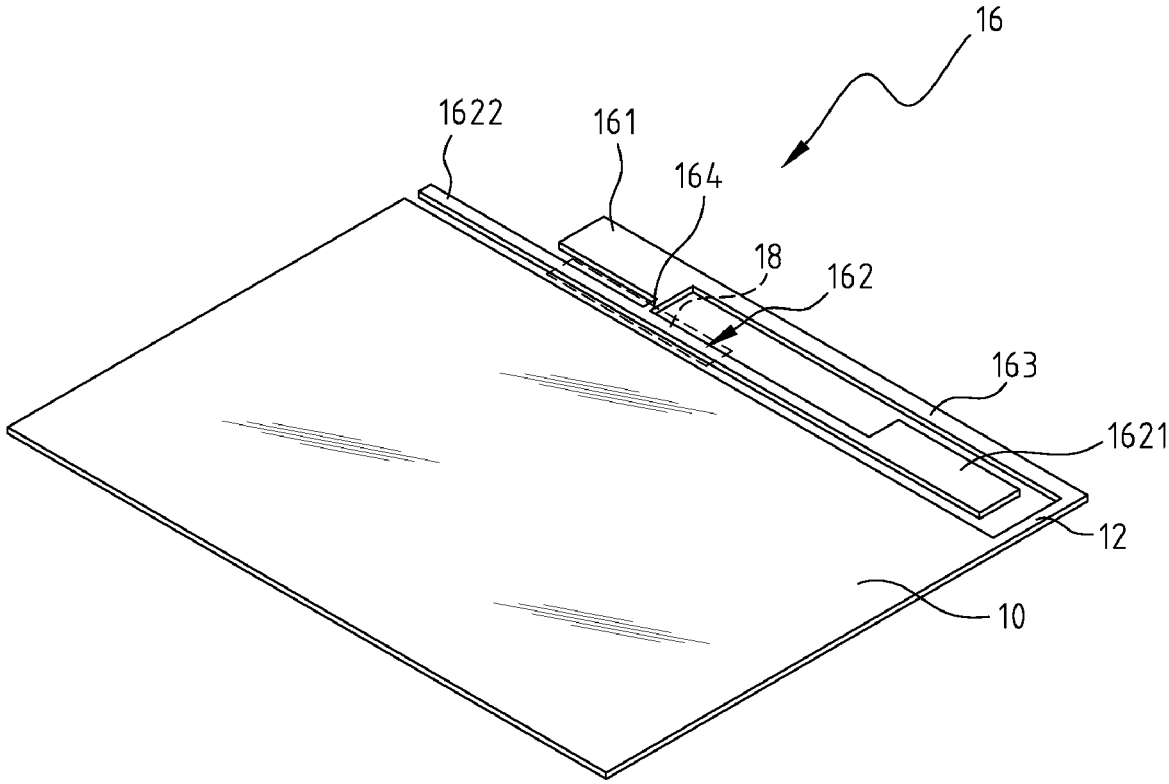

FIGS. 1A to 1C are schematic views showing a feed point adjustable planar antenna according to the present invention. As shown in FIG. 1A or 1B, the feed point adjustable planar antenna according to the present invention includes a sheet-like ground component 10, a ground pin 12, and a radiation component 16. The radiation component 16 comprises a main radiation plane 161 extended from the ground pin 12, and a branch line 162 extended from the main radiation plane 161. The branch line 162 includes a first radiation line 1621 and a second radiation line 1622 connected to form an elongate element between the main radiation plane 161 and the ground component 10. The ground pin 12 electrically connects the ground component 10 with the main radiation plane 161. One end of a coaxial cable (not shown) is connected with a radio transceiver circuit and the other end of the coaxial cable is connected with the branch line 162 for feeding signals.

The ground component 10 and the ground pin 12 may be on the same plane as shown in FIG. 1A or be respectively on two planes vertical to each other as shown in FIG. 1B.

Briefly speaking, after the antenna is designed and the size is fixed, if it needs to fine tune the frequency band interval, the position of the coaxial cable fed to the branch line 162 can be changed to fine tune the frequency band interval without cutting the antenna.

The ground pin 12 extends from a side edge of the ground component 10 and is connected with the main radiation plane 161 by a first connecting line 163. A second connecting line 164 extends from a corner of the main radiation plane 161 close to the middle portion of the edge of the ground component 10, and turns inward to form the branch line 162. The branch line 162 includes the first radiation line 1621 adjacent to the ground component 10 and the ground pin 12 and the second radiation line 1622 adjacent to the ground component 10 and the main radiation plane 161. The first radiation line

1621 is located between the ground component 10 and the first connecting line 163 so that the first radiation line 1621 has a good coupling effect. The first radiation line 1621 is a high-frequency radiation line, and the second radiation line 1622 is a low-frequency radiation line. The branch line 162 turns and extends until adjacent to the ground component 10. Therefore, the branch line 162 and the ground component 10 form a comparatively larger coupling range, and the coaxial cable also has a comparatively larger feed range than those of the conventional planar antenna.

In the structure of the antenna according to the present invention, the second connecting line 164 electrically connects the main radiation plane 161 with the branch line 162. In general, types of the second connecting line 164 are classified into a parallel type as show in FIG. 1A or 1B, and a vertical type as shown in FIG. 1C. As shown in FIG. 1A or 1B, the coaxial cable can be connected to any position of the branch line 162 to feed the signals, and changing the feed position can fine tune the frequency band interval. As shown in FIG. 1A or 1B, a preferred feed area 18 is adjacent to a connecting point of the second connecting line 164 and the branch line 162 and is within a predetermined area between the first radiation line 1621 and the second radiation line 1622. However, the preferred feed area of the planar antenna as shown in FIG. 1C is located at a place more left than that of the planar antenna as shown in FIG. 1A or 1B. Thus, the characteristics of the first radiation line 1621 and of the second radiation line 1622 as shown in FIG. 1C are opposite to those of the first radiation line 1621 and of the second radiation line 1622 as shown in FIGS. 1A and 1B. That is, the first radiation line 1621 is a low-frequency radiation line and the second radiation line 1622 is a high-frequency radiation line. Three feed points a, b and c are illustrated in the preferred feed area 18. As can be seen, moving the coaxial cable from one feed point to another feed point increases the size of the first radiation line and decreases the size of the second radiation line, or vice versa.

Generally speaking, to determine the feed position of the coaxial cable is to minimize a voltage standing wave ratio and a return loss. Thus, changing the feed position of the coaxial cable to the preferred feed area 18, the first radiation line 1621 or the second radiation line 1622 can conveniently and swiftly fine tune the frequency band interval of the planar antenna according to the present invention. It should be noted that simply changing the feed position of the coaxial cable has the same effect of fine tuning as changing the sizes of the antenna. Thus, the effect of the fine tuning by changing the feed position will not be described in detail here.

Figure 2A:
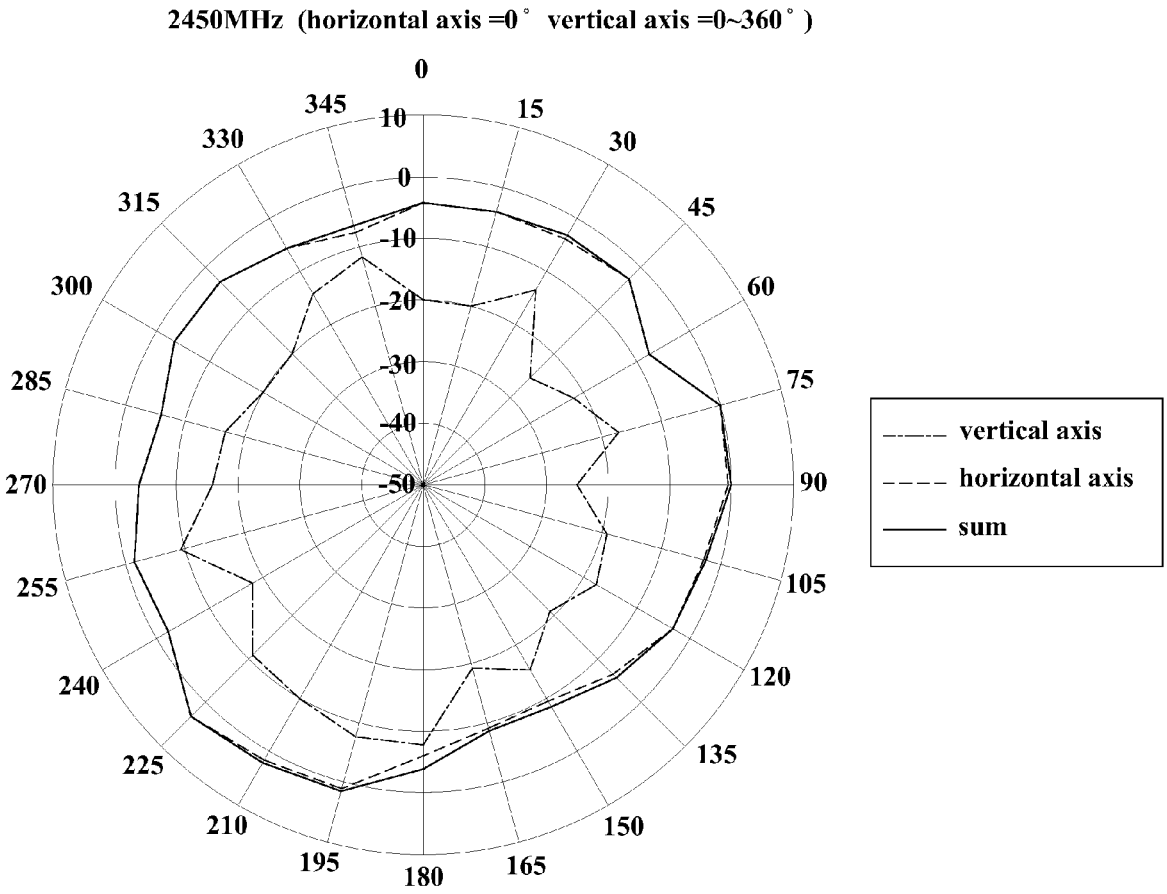
FIGS. 2A to 2C are views showing radiation patterns of the feed point adjustable planar antenna according to the present invention.
Figure 2B:
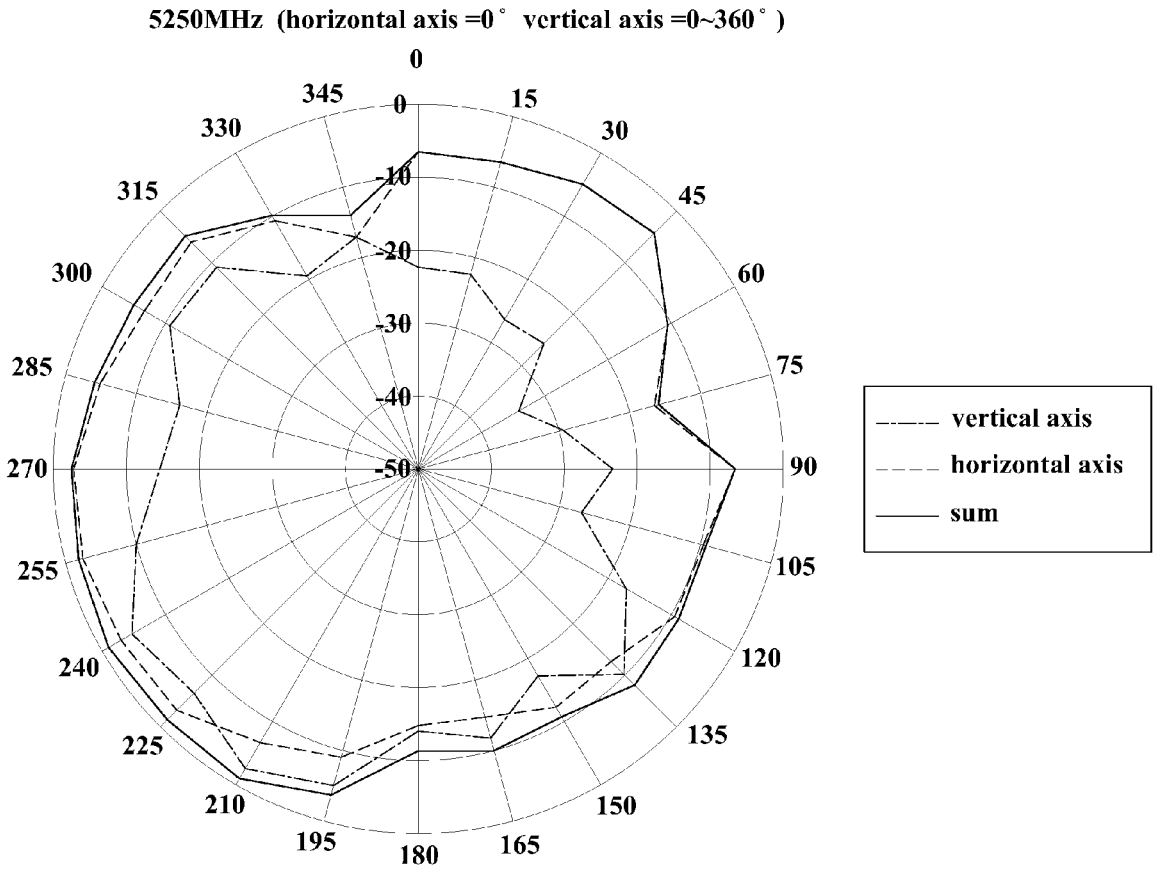
Figure 2C:
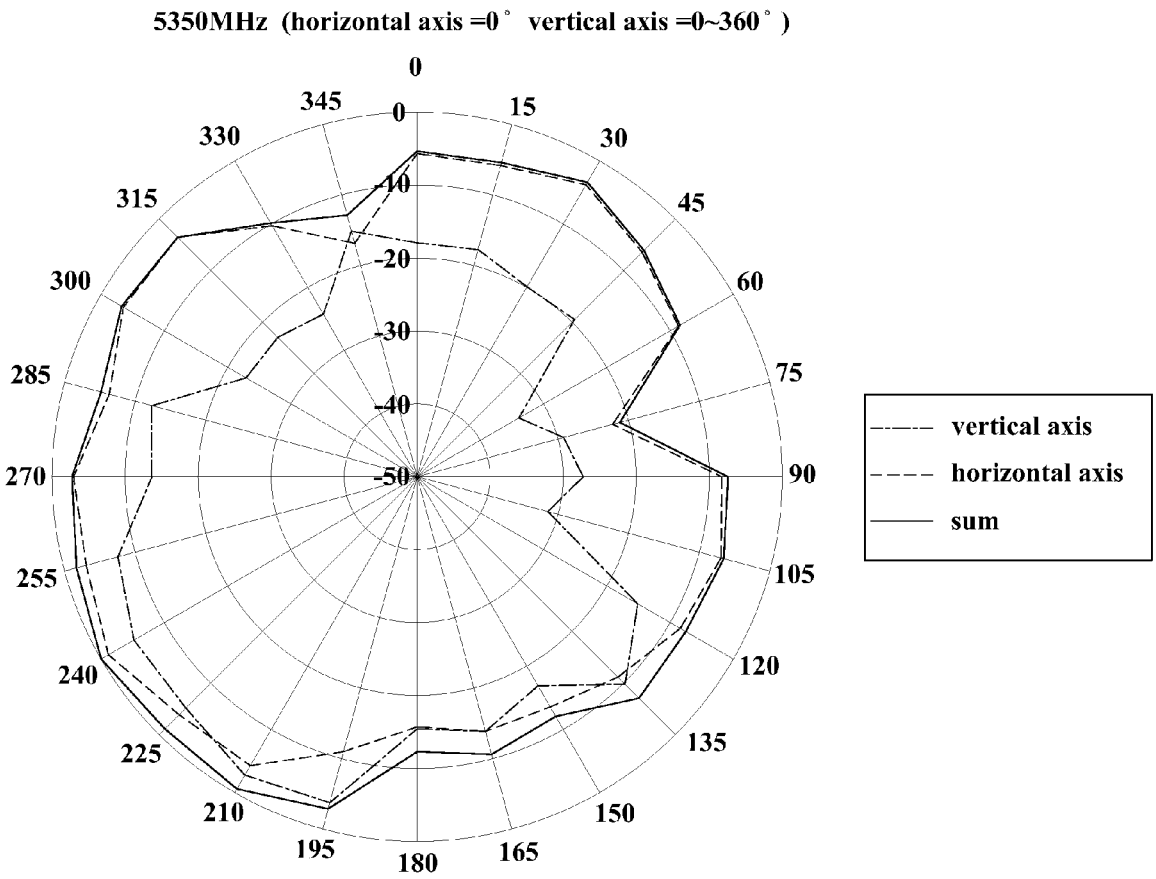

FIGS. 2A, 2B, and 2C show the measured radiation patterns of the feed point adjustable planar antenna according to the present invention, when the feed position is in the preferred feed area 18 and operation frequencies are 2.45 GHz, 5.25 GHz and 5.35 GHz respectively. These figures show that the feed point adjustable planar antenna according to the present invention satisfies the required performance.

Figure 3:
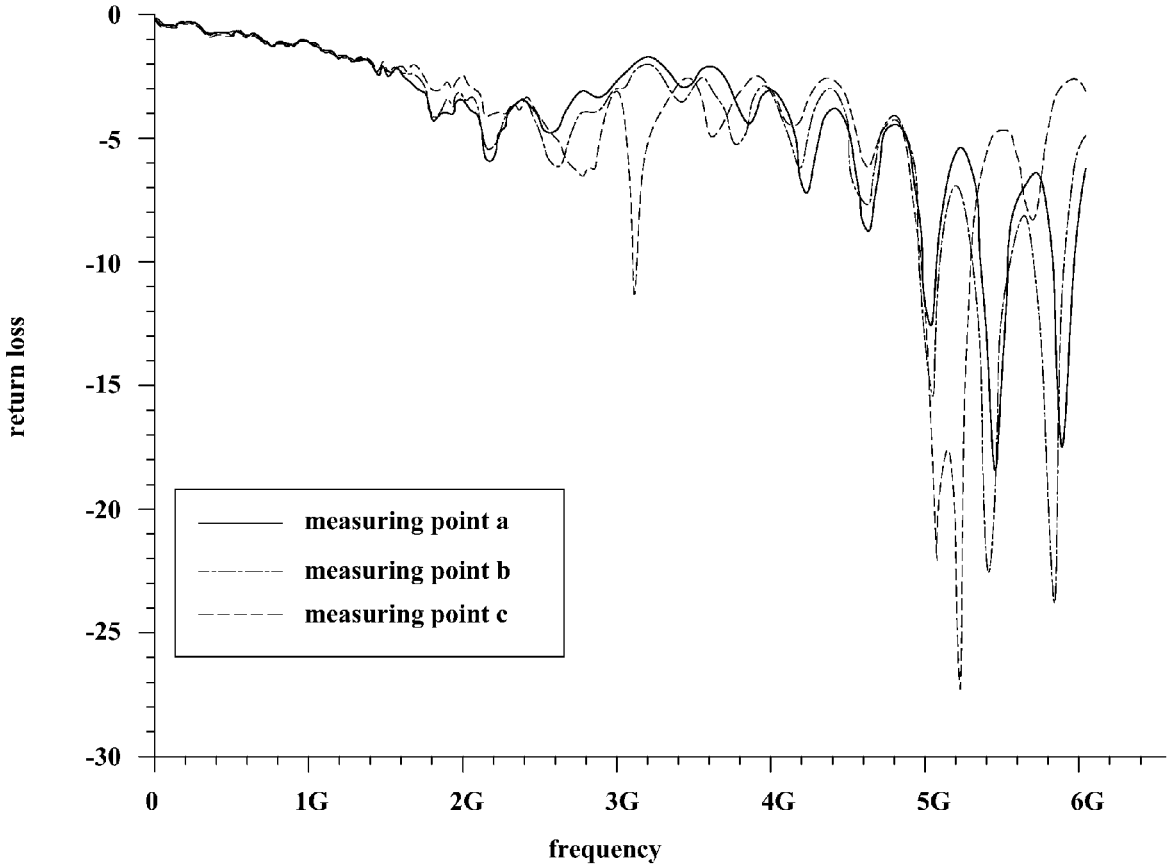
FIG. 3 is a schematic view showing a return loss of the feed point adjustable planar antenna according to the present invention.

FIG. 3 is a schematic drawing showing a return loss of the feed point adjustable planar antenna according to the present invention. FIG. 3 shows the return loss when the measurement is done at measuring points a, b and c as shown in FIGS. 1A to 1B. When the feed point is at the measuring point a, the frequency band intervals are between 2.48268 GHz and 5.38503 GHz; when the feed point is at the measuring point b, the frequency band intervals are between 2.50517 GHz and 5.36253 GHz; when the feed point is at the measuring point c, the frequency band intervals are between 2.51642 GHz and 5.35128 GHz. The distance between the measuring points a and b is 4 mm and the distance between the measuring points b and c is 4 mm. Therefore, when the feed point moves toward the low-frequency radiation line, the high frequency will bias toward the low frequency and the low frequency will bias toward the high frequency. Thus, changing the feed position can fine tune the frequency band interval of the antenna.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A feed point adjustable planar antenna electrically connected to a wireless transceiver circuit by a coaxial cable, comprising:

a ground component;

a ground pin extended from a side edge of the ground component; and a radiation component, comprising:

a main radiation plane extended from the ground pin; and at least one branch line electrically connected to the main radiation plane, and comprising a first radiation line adjacent to the ground component and the ground pin, a second radiation line adjacent to the ground component and the main radiation plane, and a feed area between the first and second radiation lines;

wherein the feed area has a plurality of feed points for connecting to the coaxial cable with each feed point providing different frequency band intervals for fine tuning frequency band intervals of the planar antenna.

2. The feed point adjustable planar antenna according to claim 1, wherein the ground pin is electrically connected to the main radiation plane by a first connecting line.

3. The feed point adjustable planar antenna according to claim 1, wherein the branch line is electrically connected to the main radiation plane by a second connecting line and the second connecting line is extended from the main radiation plane and extended inward to the branch line adjacent to the ground component.

4. The feed point adjustable planar antenna according to claim 1, wherein the ground component and the ground pin are on the same plane.

5. The feed point adjustable planar antenna according to claim 1, wherein the ground component and the ground pin are respectively on two planes perpendicular to each other.

6. The feed point adjustable planar antenna according to claim 3, wherein the second connecting line is parallel to the ground component, the first radiation line is a high-frequency radiation line and the second radiation line is a low-frequency radiation line.

7. The feed point adjustable planar antenna according to claim 3, wherein the second connecting line is vertical to the ground component, the first radiation line is a low-frequency radiation line and the second radiation line is a high-frequency radiation line.

8. The feed point adjustable planar antenna according to claim 6, wherein the feed area is adjacent to a connecting point of the second connecting line and the branch line and is within a predetermined area between the first radiation line and the second radiation line.

9. The feed point adjustable planar antenna according to claim 1, wherein the first radiation line and the second radiation line form an elongate element between the main radiation plane and the ground component.

10. The feed point adjustable planar antenna according to claim 1, wherein the size of the first radiation line is increased and the size of the second radiation line is decreased or vice versa when the coaxial cable is moved from one feed point to another feed point in the feed area.

* * * * *